US012225984B2

(12) United States Patent
Hauptman et al.

(10) Patent No.: US 12,225,984 B2
(45) Date of Patent: Feb. 18, 2025

(54) CLASP

(71) Applicants: Jonathan Hauptman, Maplewood, MN (US); Sarah Hauptman, Maplewood, MN (US)

(72) Inventors: Jonathan Hauptman, Maplewood, MN (US); Sarah Hauptman, Maplewood, MN (US)

(73) Assignee: PHLster LLC, Hugo, MN (US)

( * ) Notice: Subject to any disclaimer, the term of this patent is extended or adjusted under 35 U.S.C. 154(b) by 64 days.

(21) Appl. No.: 18/072,634

(22) Filed: Nov. 30, 2022

(65) Prior Publication Data

US 2023/0172321 A1 Jun. 8, 2023

Related U.S. Application Data

(60) Provisional application No. 63/285,523, filed on Dec. 3, 2021.

(51) Int. Cl.
*A44B 11/25* (2006.01)

(52) U.S. Cl.
CPC ..... *A44B 11/2592* (2013.01)

(58) Field of Classification Search
CPC ..... A44B 11/2592; A44B 11/2584; A44B 11/2588; Y10T 24/4522; Y10T 24/45152
USPC ..... 24/590.1, DIG. 51, DIG. 52, DIG. 56, 24/DIG. 58, DIG. 42, DIG. 44, DIG. 49
See application file for complete search history.

(56) References Cited

U.S. PATENT DOCUMENTS

| | | | | |
|---|---|---|---|---|
| 1,437,250 | A * | 11/1922 | Kerngood | A44B 11/10 24/194 |
| 1,821,839 | A * | 9/1931 | Kerngood | A44B 11/28 24/312 |
| 1,853,889 | A * | 4/1932 | Alterson | A44B 11/04 D11/218 |
| 2,115,362 | A * | 4/1938 | Freysinger | A45C 13/02 190/109 |
| 2,224,773 | A * | 12/1940 | Shaulson | A44B 11/28 24/200 |
| 3,936,914 | A * | 2/1976 | Mancini | A44C 5/2057 24/698.2 |
| 5,491,845 | A * | 2/1996 | Takimoto | A44B 11/2592 2/338 |
| 6,704,977 | B1 * | 3/2004 | Chung | A44B 11/258 24/DIG. 42 |
| 9,101,185 | B1 | 8/2015 | Greenberg | |
| 10,314,370 | B2 | 6/2019 | Brandt et al. | |
| 10,918,169 | B2 * | 2/2021 | Kolasa | A44B 99/00 |
| D987,288 | S * | 5/2023 | Hauptman | D3/222 |
| 11,730,983 | B2 * | 8/2023 | Canfield | A62B 35/0037 24/198 |
| 2002/0112323 | A1 | 8/2002 | Nire | |
| 2018/0160779 | A1 * | 6/2018 | Fildan | A41F 1/006 |
| 2018/0192745 | A1 * | 7/2018 | McDaniel | A43B 3/0047 |

(Continued)

*Primary Examiner* — Jack W Lavinder
(74) *Attorney, Agent, or Firm* — Asgaard Patent Services, LLC; F. Wayne Thompson, Jr.

(57) ABSTRACT

Disclosed are implementations of a clasp that can be used to connect one end of a leg strap to another portion of the same leg strap, thereby forming a loop. The clasp can also be used to releasably join two ends of an article, releasably join two separate articles, or for any other suitable purpose. An example clasp comprises a buckle component that mates with a catch component in an interlocking configuration.

19 Claims, 9 Drawing Sheets

(56) References Cited

U.S. PATENT DOCUMENTS

| | | | | |
|---|---|---|---|---|
| 2019/0269206 | A1* | 9/2019 | Kolasa | A44B 11/12 |
| 2019/0313746 | A1* | 10/2019 | Hetrich | A62B 35/0025 |
| 2021/0153608 | A1* | 5/2021 | Melling | A44B 11/2592 |
| 2021/0368949 | A1* | 12/2021 | Prasitkittanai | A44C 5/2057 |
| 2022/0079299 | A1* | 3/2022 | Spencer | A47D 15/00 |
| 2023/0172321 | A1* | 6/2023 | Hauptman | A44B 11/2588 24/316 |

* cited by examiner

CLASP

CROSS-REFERENCE TO RELATED APPLICATION(S)

This application claims the benefit of U.S. Provisional Application Ser. No. 63/285,523, filed on Dec. 3, 2021, the entirety of which is incorporated herein by reference.

TECHNICAL FIELD

This disclosure relates to implementations of a clasp.

BACKGROUND

Releasable clasps are often used to fasten two loose ends together, but can also be used to connect one loose end of an article to another portion of the same article to, for example, form a loop. Some clasps are more difficult to connect or release, especially when the connection is performed using only a single hand. In addition, some clasps may include a thicker profile, which can affect the comfort of the clasp against the wearer's body.

Accordingly, needs exist for the clasp disclosed herein. It is to the provision of a clasp configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed are implementations of a clasp that can be used to connect one end of a leg strap to another portion of the same leg strap, thereby forming a loop. The clasp can also be used to releasably join two ends of an article (e.g., a belt), releasably join two separate articles (e.g., two straps), or for any other suitable purpose.

An example clasp comprises a buckle component that mates with a catch component in an interlocking configuration. The buckle component comprises a mating projection that includes a catch-receiving slot and a latch projection. The catch-receiving slot is on an underside of the mating projection and the latch projection extends from a distal end of the mating projection. The catch component comprises a slot, a crossbar, and an eyelet. The slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration. The catch component further comprises two ribs configured to engage opposite sides of the latch projection, the two ribs being positioned opposite each other and below the eyelet.

Another example clasp comprises a buckle component that mates with a catch component in an interlocking configuration. The buckle component comprises a base and a mating projection. The base is configured to be coupled to a first article. The mating projection includes a catch-receiving slot and a latch projection. The catch-receiving slot is on an underside of the mating projection and the latch projection extends from a distal end of the mating projection. The catch component comprises a base, a slot, a crossbar, and an eyelet. The base is configured to be coupled to a second article. The slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration. The catch component further comprises two ribs configured to engage opposite sides of the latch projection, the two ribs being positioned opposite each other and below the eyelet.

Yet another example clasp comprises a buckle component that mates with a catch component in an interlocking configuration. The buckle component comprises a base and a mating projection. The base is configured to be coupled to an article. The mating projection includes a catch-receiving slot and a latch projection. The catch-receiving slot is on an underside of the mating projection and the latch projection extends from a distal end of the mating projection. The catch component comprises a bifurcated base, a slot, a crossbar, and an eyelet. The bifurcated base is configured to be coupled to the article. The slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration. The catch component further comprises two ribs configured to engage opposite sides of the latch projection, the two ribs being positioned opposite each other and below the eyelet.

Still another example clasp comprises a buckle component that mates with a catch component in an interlocking configuration. The buckle component comprises a mating projection that includes a catch-receiving slot and a latch projection. The catch-receiving slot is on an underside of the mating projection and the latch projection extends from a distal end of the mating projection. The catch component comprises a slot, a crossbar, and an eyelet. The slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration. The crossbar of the catch component has a substantially rectangular cross-section, and the eyelet of the catch component is shaped to allow the latch projection to slide into the eyelet and be retained. The eyelet is elliptical in shape.

Yet another example clasp comprises a buckle component that mates with a catch component in an interlocking configuration. The buckle component comprises a base and a mating projection. The base is configured to be coupled to a first article. The mating projection includes a catch-receiving slot and a latch projection. The catch-receiving slot is on an underside of the mating projection and the latch projection extends from a distal end of the mating projection. The catch component comprises a base, a slot, a crossbar, and an eyelet. The base is configured to be coupled to a second article. The slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration. The crossbar of the catch component has a substantially rectangular cross-section, and the eyelet of the catch component is shaped to allow the latch projection to slide into the eyelet and be retained. The eyelet is elliptical in shape.

Still another example clasp comprises a buckle component that mates with a catch component in an interlocking configuration. The buckle component comprises a base and a mating projection. The base is configured to be coupled to an article. The mating projection includes a catch-receiving slot and a latch projection. The catch-receiving slot is on an underside of the mating projection and the latch projection extends from a distal end of the mating projection. The catch component comprises a bifurcated base, a slot, a crossbar, and an eyelet. The bifurcated base is configured to be coupled to the article. The slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration. The catch component further comprises two ribs configured to engage opposite sides of the latch projection, the two ribs being positioned opposite each other and below the eyelet. The crossbar of the catch component has a substantially rectangular cross-section, and the eyelet of the catch component is shaped to allow the latch projection to slide into the eyelet and be retained. The eyelet is elliptical in shape.

BRIEF DESCRIPTION OF THE DRAWINGS

Like reference numerals refer to corresponding parts throughout the several views of the drawings.

DETAILED DESCRIPTION

FIGS. 1-4 illustrate an example clasp 100 according to the principles of the present disclosure. In general, the clasp 100 described herein is used to connect one end of a leg strap 160 to another portion of the same leg strap 160, thereby forming a loop (see e.g., FIG. 15). However, the clasp 100 can also be used to releasably join two ends of an article (e.g., a belt), releasably join two separate articles (e.g., two straps), or for any other suitable purpose.

Figure 1:
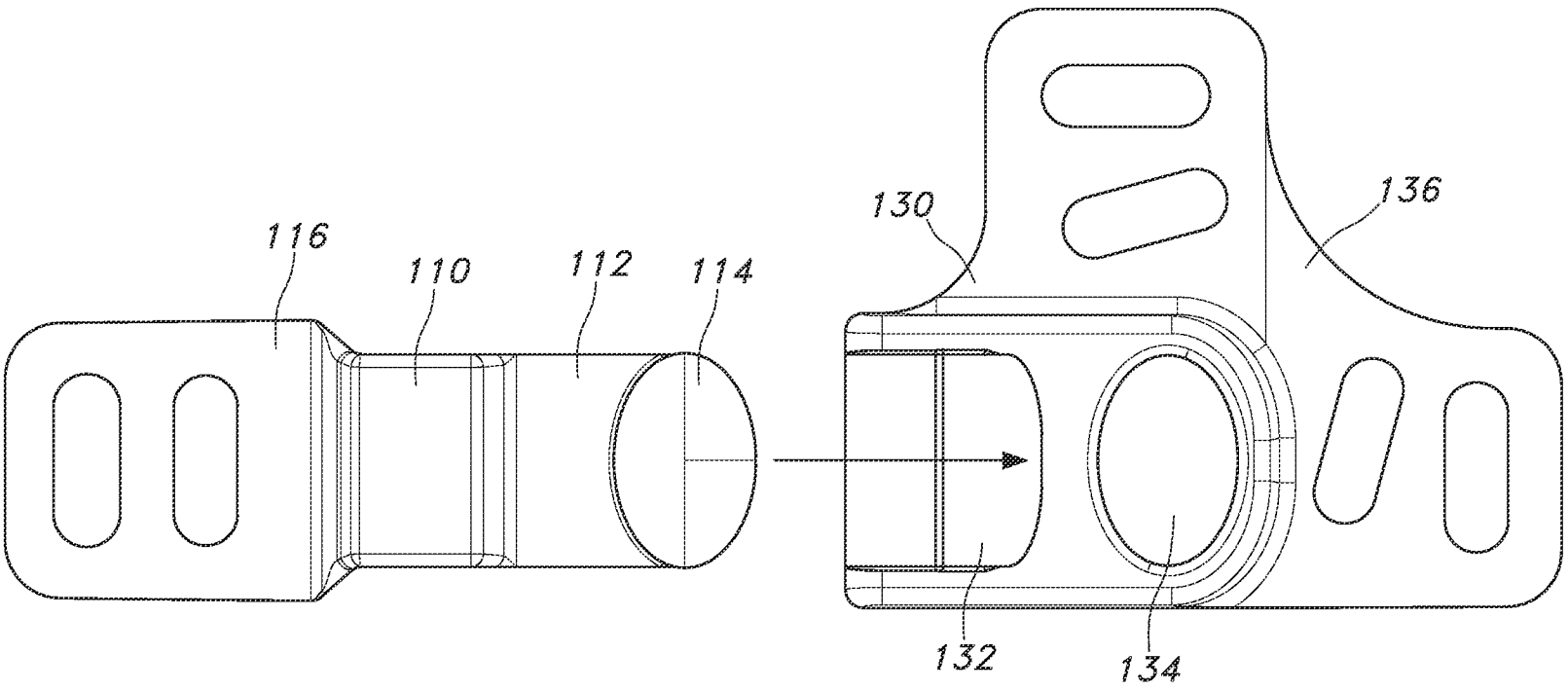
FIGS. 1-4 illustrate various positions of a buckle component and a catch component when a clasp is being operated, in accordance with the principles of the present disclosure.
Figure 2:
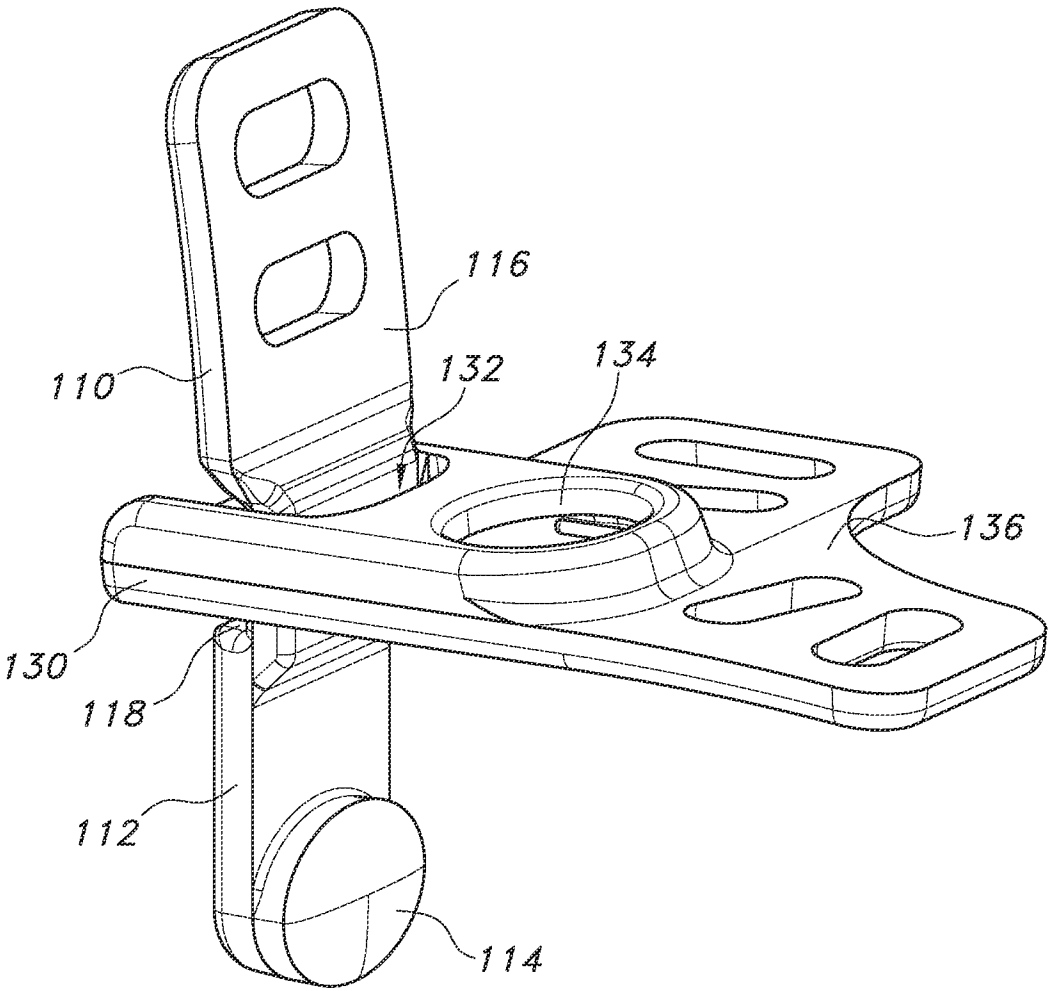
Figure 4:
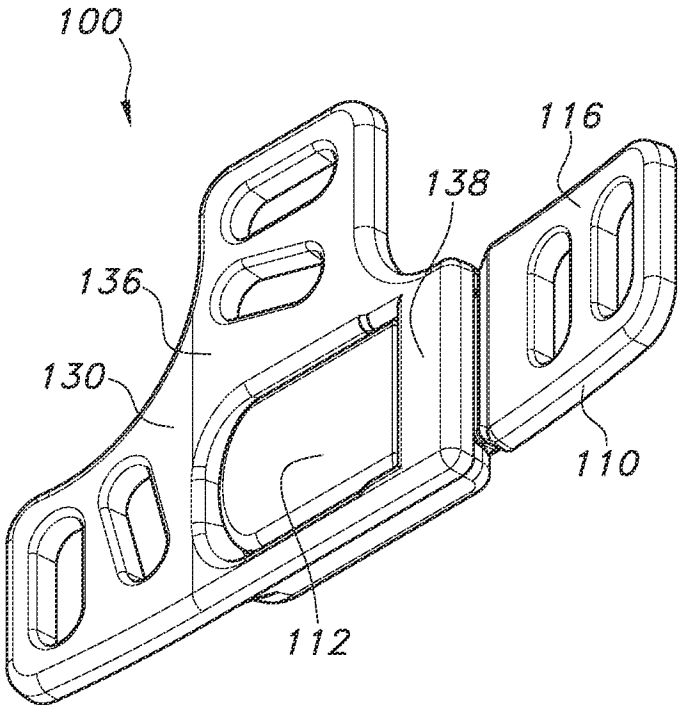
Figure 3:
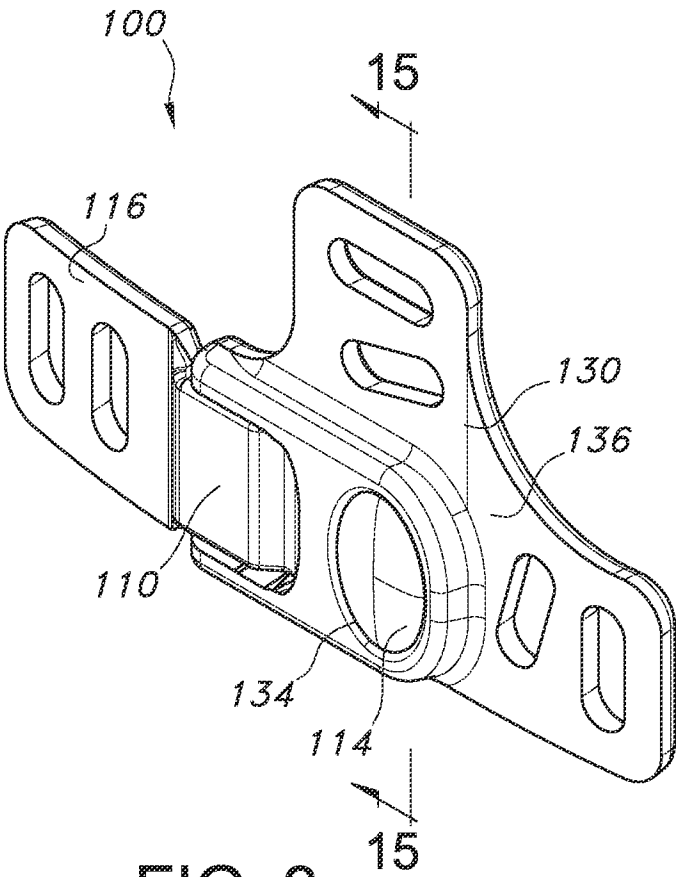
Figure 6:
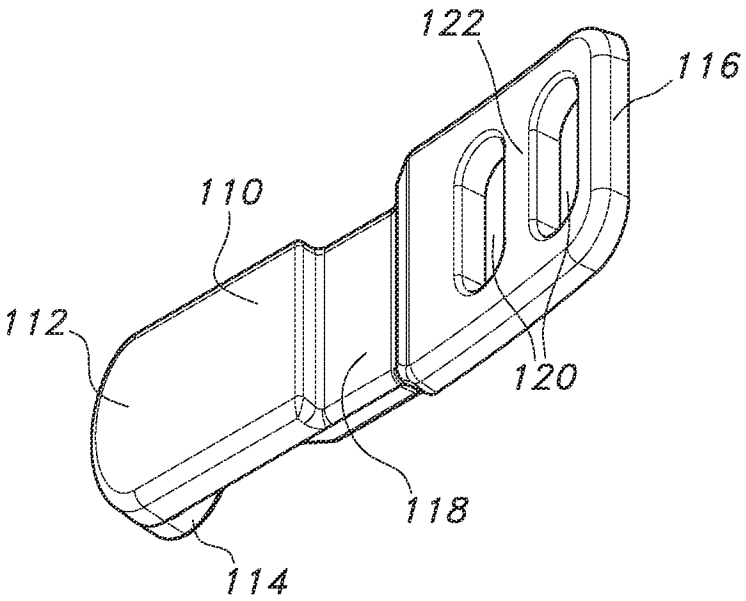
FIG. 6 illustrates another isometric view of the buckle component shown in FIG. 5.
Figure 5:
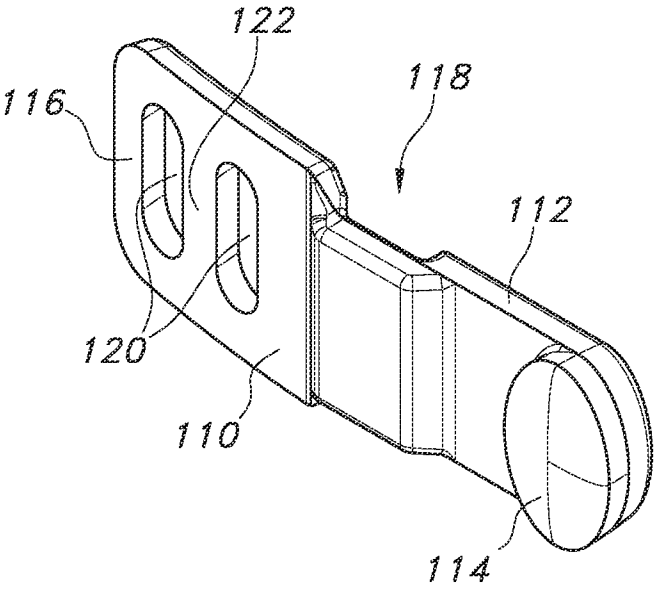
FIG. 5 illustrate an isometric view of the buckle component shown in FIGS. 1-4.
Figure 9:
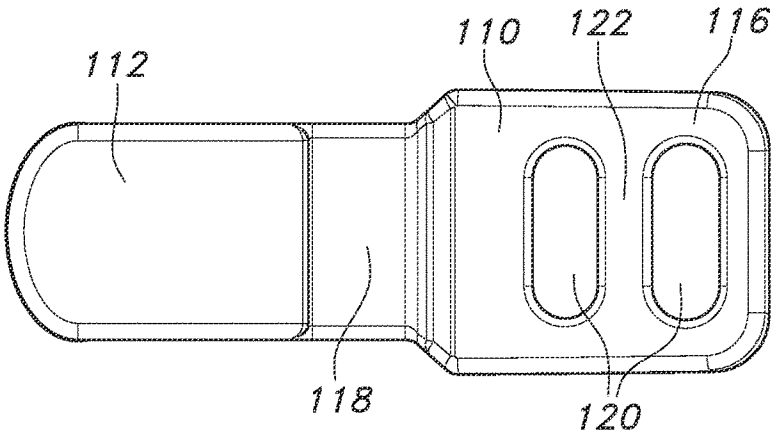
FIG. 9 illustrates a bottom plan view of the buckle component shown in FIG. 5.
Figure 8:
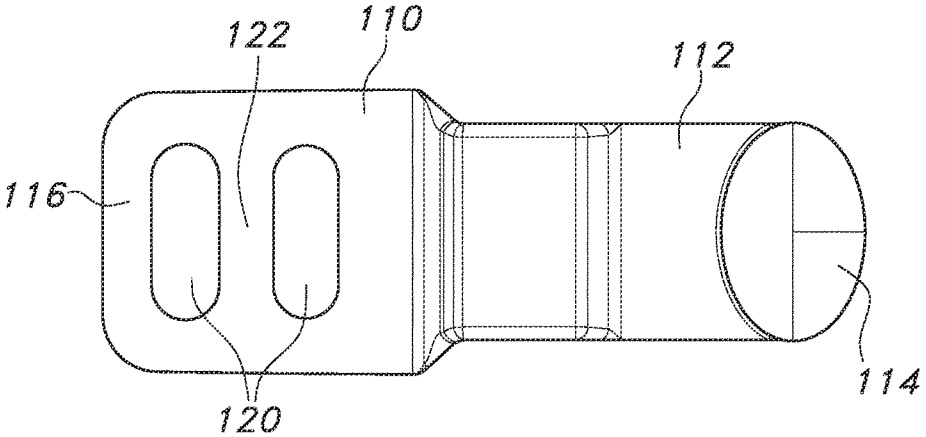
FIG. 8 illustrates a top plan view of the buckle component shown in FIG. 5.
Figure 7:
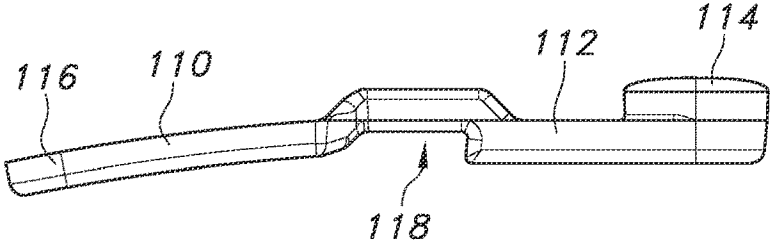
FIG. 7 illustrates a side elevational view of the buckle component shown in FIG. 5.
Figure 11:
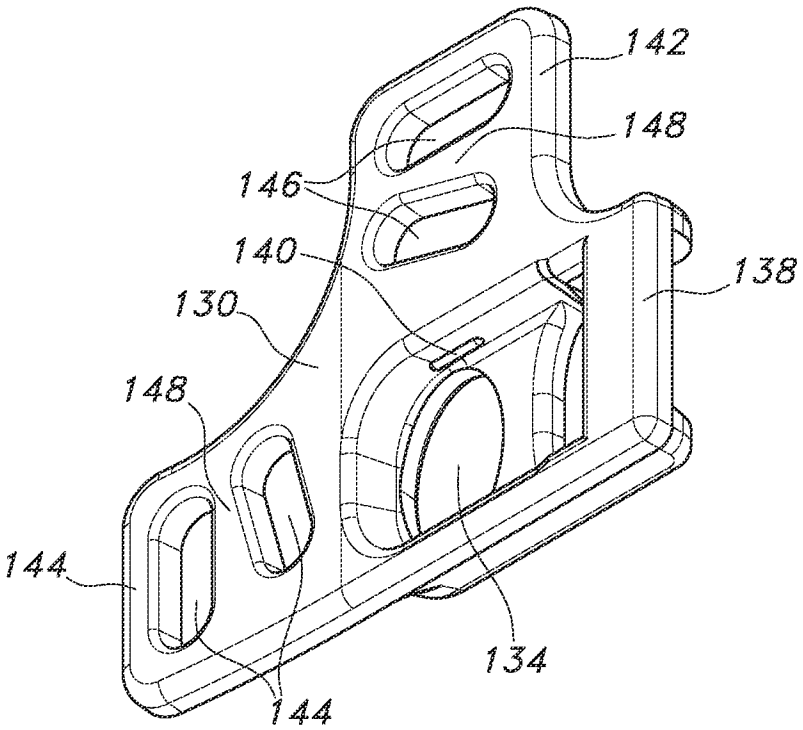
FIG. 11 illustrates another isometric view of the catch component shown in FIG. 10.
Figure 10:
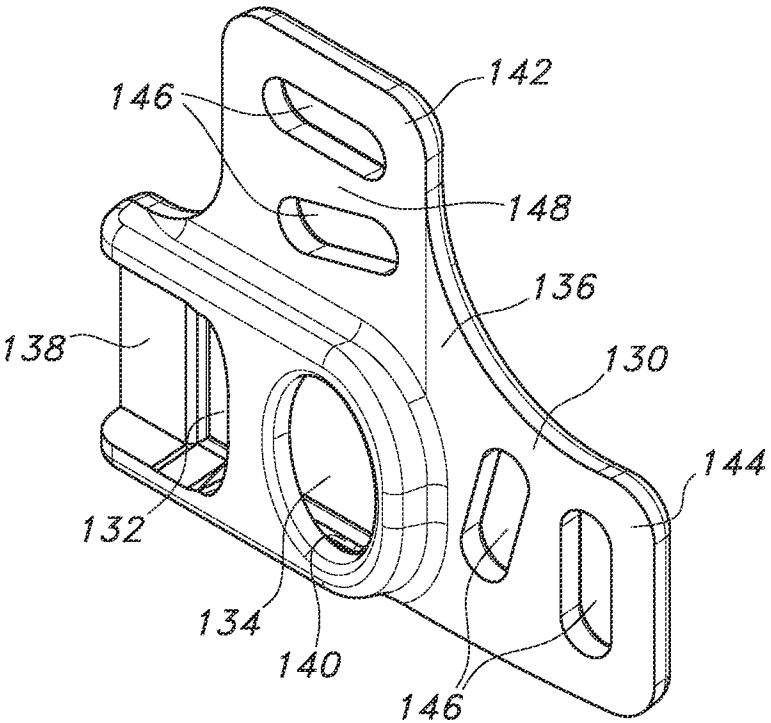
FIG. 10 illustrates an isometric view of the catch component shown in FIGS. 1-4.

As shown in FIGS. 1-4, the clasp 100 comprises a buckle component 110 that mates with a catch component 130 in an interlocking configuration. Each of FIGS. 1-3 depict a different position of the buckle component 110 relative to the catch component 130 in the operation of the clasp 100. FIG. 1 depicts that a portion 112 of the buckle component 110 is inserted, in the direction indicated by the arrow, through a slot 132 of the catch component 130. FIG. 2 depicts a portion 112 of the buckle component 110 extending through the slot 132 of the catch component 130. The position depicted in FIG. 2 occurs sequentially after the positioning depicted in FIG. 1 when the components 110, 130 are being mated and may occur sequentially before the position depicted in FIG. 1 when the components 110, 130 are being decoupled. In order to mate the buckle component 110 and the catch component 130 in the interlocking configuration, at least one of the components 110, 130 is rotated in order to align the latch projection 114 of the buckle component 110 with the eyelet 134 of the catch component 130. Once the latch projection 114 and the eyelet 134 are aligned, the latch projection 114 of the buckle component 110 is pressed into the eyelet 134 of the catch component 130 to achieve the interlocking configuration shown in FIGS. 3 and 4.

Various structures of the buckle component 110 and the catch component 130 contribute to retaining the clasp 100 in the interlocking configuration, the specifics of which will be described in further detail below.

As shown in FIGS. 5-9, the example buckle component 110 includes a mating projection 112 connected to a base 116.

The mating projection 112 of the buckle component 110 includes a latch projection 114 extending from a distal end thereof and a catch-receiving slot 118. The latch projection 114 is configured (e.g., shaped) to fit in the eyelet 134 of the catch component 130. The latch projection 114 of the buckle component 110, when positioned within the eyelet 134 of the catch component 130, acts as a retention feature that resist lateral and torsion forces applied to the assembled clasp 100. The catch-receiving slot 118 is located on the underside of the mating projection 112, between the latch projection 114 and the base 116 of the buckle component 110. The catch-receiving slot 118 is configured to receive and retain a portion (i.e., the crossbar 138) of the catch component 130 therein. The shape of the latch projection 114 contributes to a desired fit between the buckle component 110 and the portion (i.e., the eyelet 134) of the catch component 130 that receives the latch projection 114; the shape of the catch-receiving slot 118 contributes to a desired fit between the buckle component 110 and the portion (i.e., the crossbar 138) of the catch component 130 that is retained in the catch-receiving slot 118.

The base 116 of the buckle component 110 defines two loopholes 120 separated by a crossbar 122. Each of the two loopholes 120 is shaped so that a portion of the leg strap 160 can pass through. In this way, the base 116 of the buckle component 110 acts as a tri-glide, well known to those of ordinary skill in the art.

As shown in FIGS. 10-14, the example catch component 130 includes a slot 132, an eyelet 134, and, in some implementations, a bifurcated base 136.

The slot 132 of the catch component 130 is shaped so the distal end of the mating projection 112 can pass thought the slot 132 during assembly/disassembly of the clasp 100 (see, e.g., FIG. 2). The slot 132 is partially defined by a crossbar 138 shaped to be received by the catch-receiving slot 118 of the buckle component 110 (see, e.g., FIG. 3). The crossbar 138, when positioned within the catch-receiving slot 118 of the buckle component 110, acts as a retention feature (or locking-bar) that resist lateral and torsion forces applied to the clasp 100. The crossbar 138 also acts as a hinge point during assembly/disassembly of the clasp 100. The crossbar 138 of the example catch component 130 has a substantially rectangular cross-section. However, in some implementations, the crossbar 138 could have another cross-sectional shape.

The eyelet 134 of the catch component 130 is shaped to affect the fit of the latch projection 114 within the eyelet 134. The shape of the eyelet 134 corresponds with the shape of the latch projection 114 in a manner that allows the latch projection 114 to slide into the eyelet 134 and be retained in the eyelet 134. Furthermore, the shape of the eyelet 134 corresponded with the latch projection 114 in a manner to provide a friction fit between the components (see, e.g., FIG. 15). The eyelet 134 of the example catch component 130 is elliptical in shape. However, in some implementations, the eyelet 134 could be circular in shape.

Figure 14:
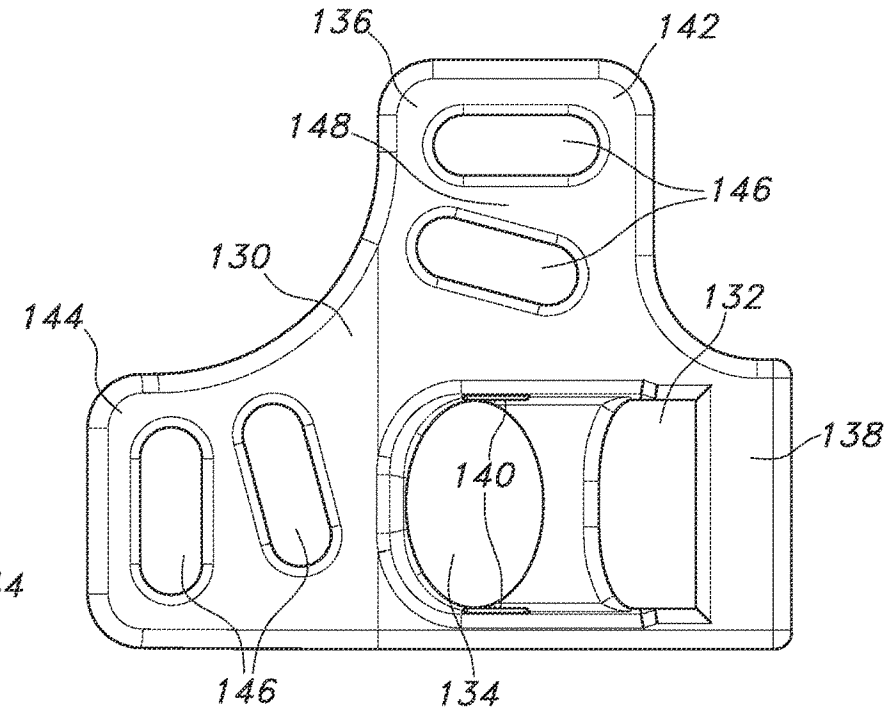
FIG. 14 illustrates a bottom plan view of the catch component shown in FIG. 10.
Figure 13:
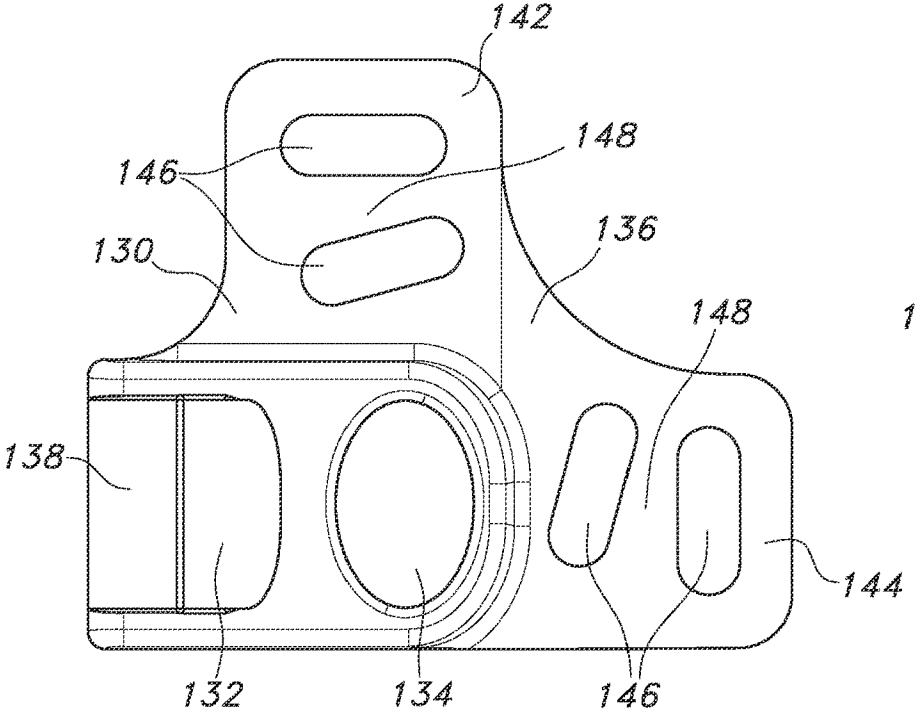
FIG. 13 illustrates a top plan view of the catch component shown in FIG. 10.
Figure 12:
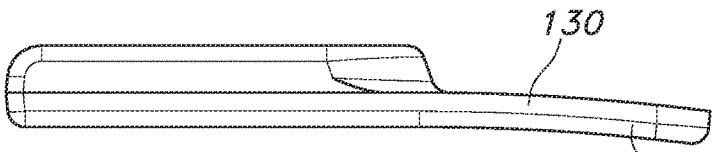
FIG. 12 illustrates a side elevational view of the catch component shown in FIG. 10.
Figure 15:
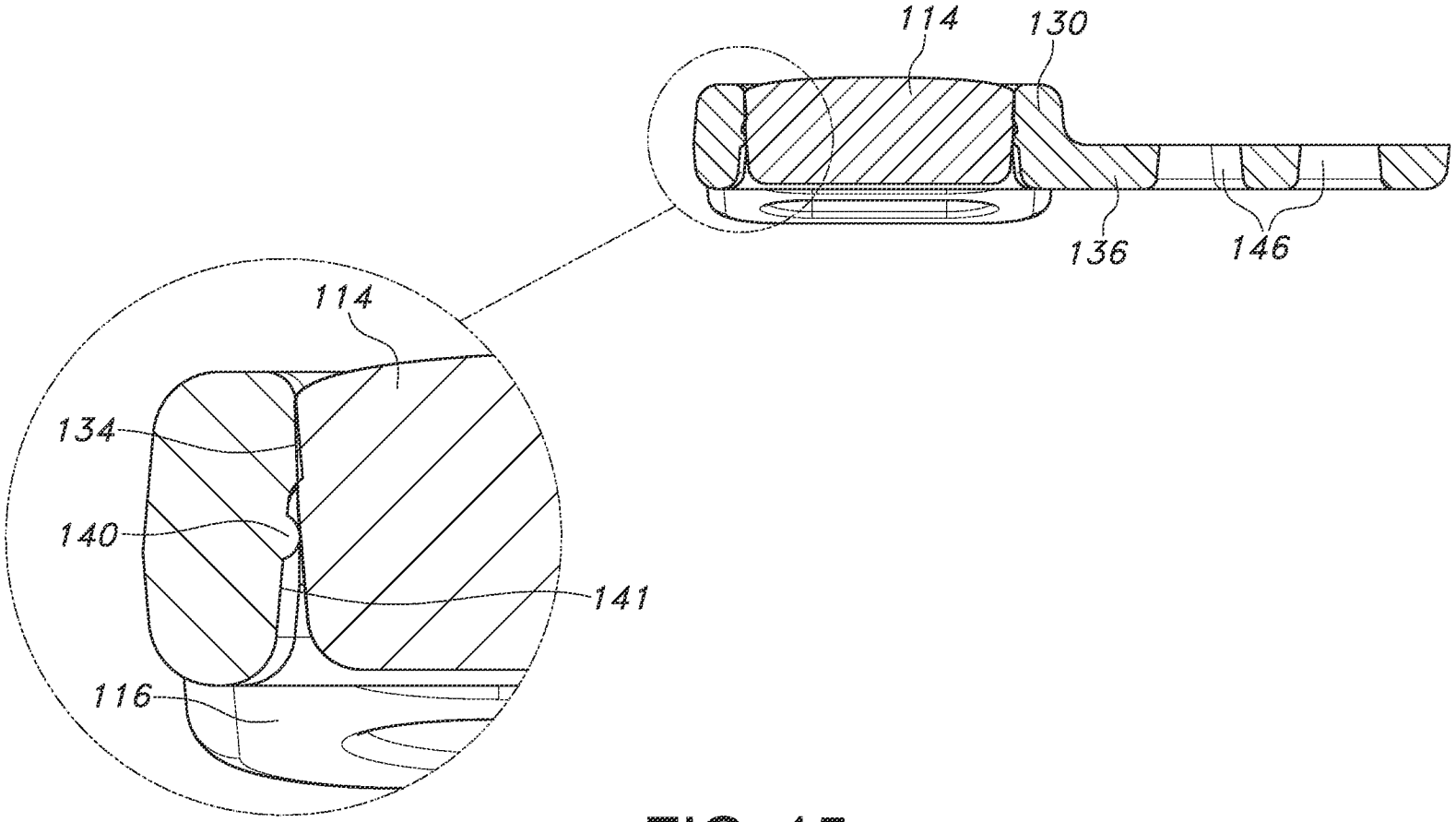
FIG. 15 illustrates a cutaway view of the clasp taken along line 15-15 shown in FIG. 3.

In some implementations, as shown in FIGS. 14 and 15, two horizontally oriented ribs 140 are positioned opposite each other and below the eyelet 134 of the catch component 130. Each of the horizontally oriented ribs 140 is an elongate protrusion extending from an interior sidewall 141 of the catch component 130. The ribs 140 are configured to engage the latch projection 114 on opposite sides. The two ribs 140 contribute to the desired fit between the eyelet 134 of the catch component 130 and the latch projection 112 of the buckle component 110.

The bifurcated base 136 of the catch component 130 is configured to reroute the leg strap 160 and comprises two separate bases 142, 144. Each base 142, 144 defines two loopholes 146 separated by a crossbar 148. Each of the two loopholes 146 is shaped so the leg strap 160 can be threaded through. In this way, each base 142 of the catch component 130 acts as a tri-glide, well known to those of ordinary skill in the art. As shown best in FIG. 16, the bifurcated base 136 gradually changes the route of the leg strap 160 as it is threaded through the loopholes 146 of each base 142, 144.

The buckle component 110 and the catch component 130 of the clasp 100 can be manufactured using 3D printing, or injection molding. The buckle component 110 and the catch component 130 are made of a nylon 12 material, though other suitable materials known to those of ordinary skill in the art could be used.

Figure 16:
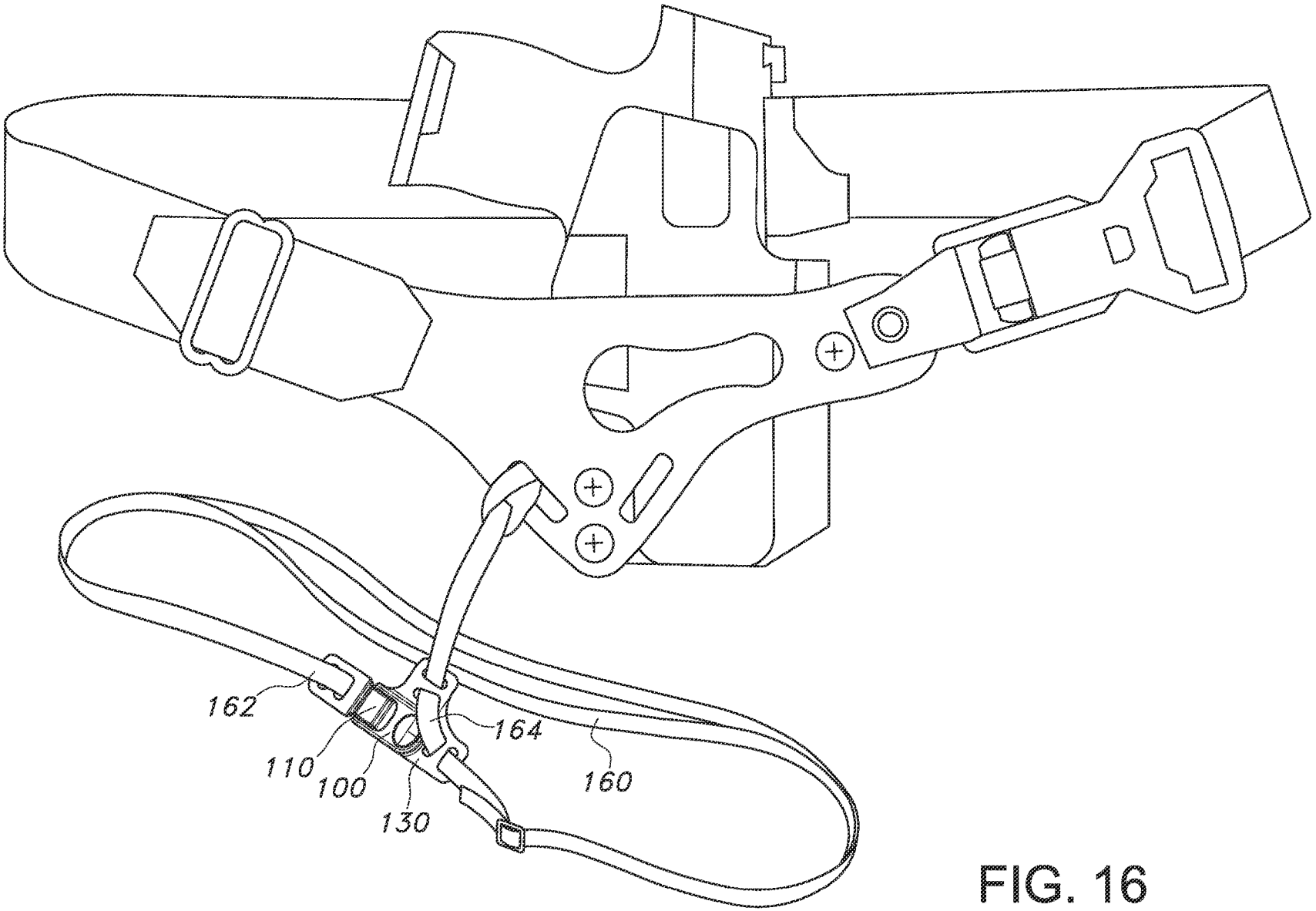
FIG. 16 illustrates a handgun and a concealable holster system that includes a leg strap, wherein a clasp according to the principles of the present disclosure is being used to couple an end of the leg strap to another portion of the leg strap.

As shown in FIG. 16, the buckle component 110 mates with the catch component 130 in an interlocking configuration to couple an end 162 of a leg strap 160 to another portion 164 of the leg strap 160. In this way, a loop is formed by the portion of the leg strap 160 extending between the buckle component 110 and the catch component 130 of the clasp 100. The example leg strap 160 may comprise a flat or tubular webbing of a narrow width, such as ¼"/6 mm tubular webbing or gutted 550/650-spec parachute cordage (a.k.a. "para-cord").

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A clasp comprising:

a buckle component that mates with a catch component in an interlocking configuration;

the buckle component comprising a mating projection that includes a catch-receiving slot and a latch projection, the catch-receiving slot is on an underside of the mating projection and the latch projection extends from a distal end of the mating projection; and the catch component comprising a slot, a crossbar, and an eyelet, the slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration;

wherein the catch component further comprises two ribs configured to engage opposite sides of the latch projection, the two ribs being positioned opposite each other and below the eyelet.

2. The clasp of claim 1, wherein the crossbar of the catch component has a substantially rectangular cross-section.

3. The clasp of claim 2, wherein the eyelet of the catch component is shaped to allow the latch projection to slide into the eyelet and be retained in the eyelet.

4. The clasp of claim 3, wherein the eyelet of the catch component is elliptical in shape.

5. The clasp of claim 1, wherein each of the two ribs is an elongate protrusion extending from an interior sidewall of the catch component.

6. A clasp for joining two articles, the clasp comprising:

a buckle component that mates with a catch component in an interlocking configuration;

the buckle component comprising a base and a mating projection, the base is configured to be coupled to a first article, the mating projection includes a catch-receiving slot and a latch projection, the catch-receiving slot is on an underside of the mating projection and the latch projection extends from a distal end of the mating projection; and the catch component comprising a base, a slot, a crossbar, and an eyelet, the base is configured to be coupled to a second article, the slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration;

wherein the catch component further comprises two ribs configured to engage opposite sides of the latch projection, the two ribs being positioned opposite each other and below the eyelet.

7. The clasp of claim 6, wherein the crossbar of the catch component has a substantially rectangular cross-section.

8. The clasp of claim 7, wherein the eyelet of the catch component is shaped to allow the latch projection to slide into the eyelet and be retained in the eyelet.

9. The clasp of claim 8, wherein the eyelet of the catch component is elliptical in shape.

10. The clasp of claim 6, wherein each of the two ribs is an elongate protrusion extending from an interior sidewall of the catch component.

11. A clasp used to form an article into a loop, the clasp comprising:

a buckle component that mates with a catch component in an interlocking configuration;

the buckle component comprising a base and a mating projection, the base is configured to be coupled to an article, the mating projection includes a catch-receiving slot and a latch projection, the catch-receiving slot is on an underside of the mating projection and the latch projection extends from a distal end of the mating projection; and the catch component comprising a bifurcated base, a slot, a crossbar, and an eyelet, the bifurcated base is configured to be coupled to the article, the slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration;

wherein the catch component further comprises two ribs configured to engage opposite sides of the latch projection, the two ribs being positioned opposite each other and below the eyelet.

12. The clasp of claim 11, wherein the crossbar of the catch component has a substantially rectangular cross-section.

13. The clasp of claim 12, wherein the eyelet of the catch component is shaped to allow the latch projection to slide into the eyelet and be retained in the eyelet.

14. The clasp of claim 13, wherein the eyelet of the catch component is elliptical in shape.

15. The clasp of claim 11, wherein each of the two ribs is an elongate protrusion extending from an interior sidewall of the catch component.

16. The clasp of claim 11, wherein the bifurcated base comprises two separate bases, each of the two separate bases is configured to be coupled to the article.

17. A clasp comprising:

a buckle component that mates with a catch component in an interlocking configuration;

the buckle component comprising a mating projection that includes a catch-receiving slot and a latch projection, the catch-receiving slot is on an underside of the mating projection and the latch projection extends from a distal end of the mating projection; and the catch component comprising a slot, a crossbar, and an eyelet, the slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration;

wherein:

the crossbar of the catch component has a substantially rectangular cross-section;

the eyelet of the catch component is shaped to allow the latch projection to slide into the eyelet and be retained in the eyelet; and the eyelet of the catch component is elliptical in shape.

18. A clasp for joining two articles, the clasp comprising:

a buckle component that mates with a catch component in an interlocking configuration;

the buckle component comprising a base and a mating projection, the base is configured to be coupled to a first article, the mating projection includes a catch-receiving slot and a latch projection, the catch-receiving slot is on an underside of the mating projection and the latch projection extends from a distal end of the mating projection; and the catch component comprising a base, a slot, a crossbar, and an eyelet, the base is configured to be coupled to a second article, the slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration;

wherein:

the crossbar of the catch component has a substantially rectangular cross-section;

the eyelet of the catch component is shaped to allow the latch projection to slide into the eyelet and be retained in the eyelet; and the eyelet of the catch component is elliptical in shape.

19. A clasp used to form an article into a loop, the clasp comprising:

a buckle component that mates with a catch component in an interlocking configuration;

the buckle component comprising a base and a mating projection, the base is configured to be coupled to an article, the mating projection includes a catch-receiving slot and a latch projection, the catch-receiving slot is on an underside of the mating projection and the latch projection extends from a distal end of the mating projection; and the catch component comprising a bifurcated base, a slot, a crossbar, and an eyelet, the bifurcated base is configured to be coupled to the article, the slot is configured so the distal end of the mating projection can pass through the slot, the crossbar is configured to be received and retained by the catch-receiving slot when the buckle component is mated with the catch component to achieve the interlocking configuration, and the eyelet is configured to receive and retain the latch projection when the buckle component is mated with the catch component to achieve the interlocking configuration;

wherein:

the crossbar of the catch component has a substantially rectangular cross-section;

the eyelet of the catch component is shaped to allow the latch projection to slide into the eyelet and be retained in the eyelet; and the eyelet of the catch component is elliptical in shape.

* * * * *